US006651948B2

(12) United States Patent
Szarata

(10) Patent No.: US 6,651,948 B2
(45) Date of Patent: Nov. 25, 2003

(54) SYSTEM FOR HANGING A PICTURE FRAME

(75) Inventor: Matthias Szarata, Bornheim (DE)

(73) Assignee: Hasenkamp Internationale Transporte GmbH, Frechen (DE)

( * ) Notice: Subject to any disclaimer, the term of this patent is extended or adjusted under 35 U.S.C. 154(b) by 0 days.

(21) Appl. No.: 10/025,829

(22) Filed: Dec. 26, 2001

(65) Prior Publication Data

US 2002/0092959 A1 Jul. 18, 2002

(30) Foreign Application Priority Data

Dec. 28, 2000 (DE) ..... 200 21 871

(51) Int. Cl.[7] ..... A47G 1/16
(52) U.S. Cl. ..... 248/493; 248/489
(58) Field of Search ..... 248/489, 495, 248/493, 491, 492, 496, 322, 339, 328; 40/762

(56) References Cited

U.S. PATENT DOCUMENTS

| | | | | | |
|---|---|---|---|---|---|
| 234,609 | A | * | 11/1880 | Prescott | 248/495 |
| 1,107,686 | A | * | 8/1914 | Mehrmann | 248/489 |
| 1,455,961 | A | | 5/1923 | Maier | |
| 1,792,326 | A | | 2/1931 | Samard | |
| 2,943,831 | A | * | 7/1960 | Goss | 248/495 |
| 2,952,431 | A | * | 9/1960 | Pedley | 248/495 |
| 3,285,549 | A | * | 11/1966 | Cook | 248/495 |
| 4,557,455 | A | * | 12/1985 | Benjamin | 24/16 PB |
| 5,314,159 | A | | 5/1994 | Szarata | |
| 5,816,557 | A | * | 10/1998 | Tepper | 248/476 |
| 5,878,987 | A | | 3/1999 | Hayde | |
| 5,947,438 | A | * | 9/1999 | Lemire | 248/476 |
| 6,241,210 | B1 | * | 6/2001 | Brindisi | 248/476 |
| 6,318,698 | B1 | * | 11/2001 | Hansen | 248/489 |
| 6,508,450 | B2 | * | 1/2003 | Hayde | 248/489 |

FOREIGN PATENT DOCUMENTS

| | | | |
|---|---|---|---|
| DE | 3706796 | * | 3/1987 |
| DE | 92 16 604 | | 1/1993 |
| DE | 296 05 744 U1 | | 7/1996 |
| DE | 200 09 474 | | 10/2000 |
| EP | 0 538 741 | | 4/1993 |
| EP | 1 034 727 | | 9/2000 |

OTHER PUBLICATIONS

"Track & Slide The Adjustable and Secure Hanging System", (US Patent 5,878,987).

* cited by examiner

*Primary Examiner*—Anita King
*Assistant Examiner*—Tan Le
(74) *Attorney, Agent, or Firm*—Nixon Peabody LLP; David S. Safran

(57) ABSTRACT

System for hanging picture frames and other essentially panel-shaped articles. The hanging system has at least one hanger which is attachable to a picture frame and on which a support element is detachably mountable and which is able to project beyond the picture frame to which the hanger is attached in use. The hanger has at least one holding mechanism for a hanging cord by which the picture frame can be hung on the hanging cord. The holding mechanism has a clamping device which is connected to the hanger and by which the hanging cord is fixedly securable to the hanger by clamping.

30 Claims, 3 Drawing Sheets

SYSTEM FOR HANGING A PICTURE FRAME

BACKGROUND OF THE INVENTION

1. Field of the Invention

This invention relates to a system for hanging a picture frame or other essentially panel-shaped article in which the hanging system has at least one hanger which can be permanently attached to the picture frame and on which a support element can be detachably mounted, projecting beyond the picture frame and/or with a capacity to slide, fold or swivel, the hanger having at least one holding means for the hanging cord so that the picture frame can be hung on the hanging cord.

In the subsequent description the hanging system is always explained in conjunction with a picture frame which is to be hung or which can be hung. However, the teaching of this invention is not limited thereto. In particular, the hanging system can also be used for other, especially essentially panel-shaped articles, such as a poster support, other objet d'art or the like.

2. Description of Related Art

Published European Patent Application EP 0 538 741 A1 and corresponding U.S. Pat. No. 5,314,159, which comprise the starting point of this invention, disclose a hanging system in which hangers are securely mounted in the corner areas of the picture frame. At least the top hangers each have a retaining clip as a holding means for a hanging cord so that the picture frame, if necessary, can be hung on hanging cords. In addition, the hangers are made such that rail-shaped support elements can be detachably mounted on the hangers so that the support elements project laterally in sections over the picture frame and enable the picture frame to be attached or held for transport purposes, especially in a corresponding transport case.

In the known hanging systems, at least one additional, separate connecting element is necessary to be able to connect a hanging cord to an assigned retaining clip. For example, a hook as the connecting element is attached first to the hanging cord which is then hooked into the retaining clip. This results in several disadvantages. The separate connecting elements can be lost. Existing connecting elements or those prepared by way of replacement can be dimensioned such that they cannot be joined, at least not reliably enough, to the retaining clips. Moreover, vertical adjustment is complex, since the picture frame must first be removed again and then the connecting element on the hanging cord must be vertically adjusted.

SUMMARY OF THE INVENTION

In view of the foregoing, a primary object of this invention is to devise a system for hanging a picture frame or other article in which simple handling and versatile use are enabled, and especially the aforementioned disadvantages of the prior art can be avoided.

This object is achieved, in accordance with the invention, by a hanging system in which the holding means has a clamping means which is or can be securely connected to the hanger and which is made such that the hanging cord can be fixed by clamping. The basic idea of this invention lies in providing the hanging system, especially in addition, with a clamping means for fixing the hanging cord on the hanger by clamping, and the clamping means is or at least can be connected securely to the hanger.

The approach in accordance with the invention leads to there being no need for a separate connecting element or the like. Rather, a hanging cord can be fixed by clamping directly on the hanger by the clamping means. This enables simple handling, there being no risk of loss of a separate connecting element. Moreover simple vertical adjustment is enabled, if necessary, by fixation by clamping.

In particular, the clamping means is provided in addition. Accordingly, the possible applications of the hanging system according to the invention are expanded. Therefore, there is great versatility.

The "hanging system" is defined here especially as a system which can be used both for hanging an assigned picture frame or painting and also for holding or support in transport—therefore as transport protection. With respect to the execution and utility as transport protection reference is made especially to EP 0 538 741 A1 and its above noted U.S. counterpart. In particular, the hanging system of the invention can be formed and/or used as disclosed in these publications.

The subject matter of the invention is also a hanger as such which can be used for a hanging system in accordance with the invention.

Other details, features, aspects and advantages of this invention will become apparent from the following description of a preferred embodiment and the accompanying drawings.

DETAILED DESCRIPTION OF THE INVENTION

Figure 1:
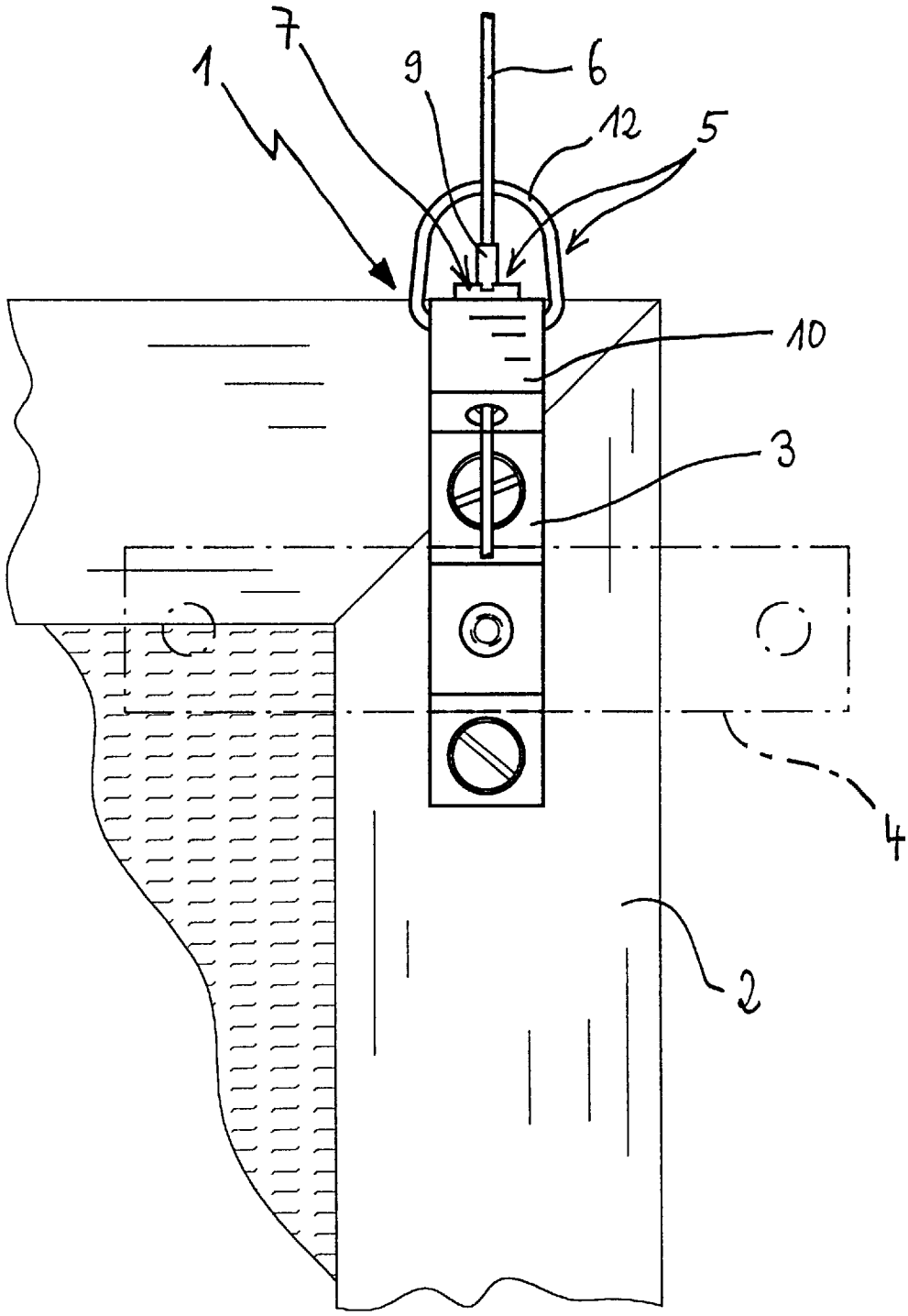
FIG. 1 shows a schematic back view of the corner area of a picture frame which has been hung with the hanging system as claimed in the invention.
Figure 2:
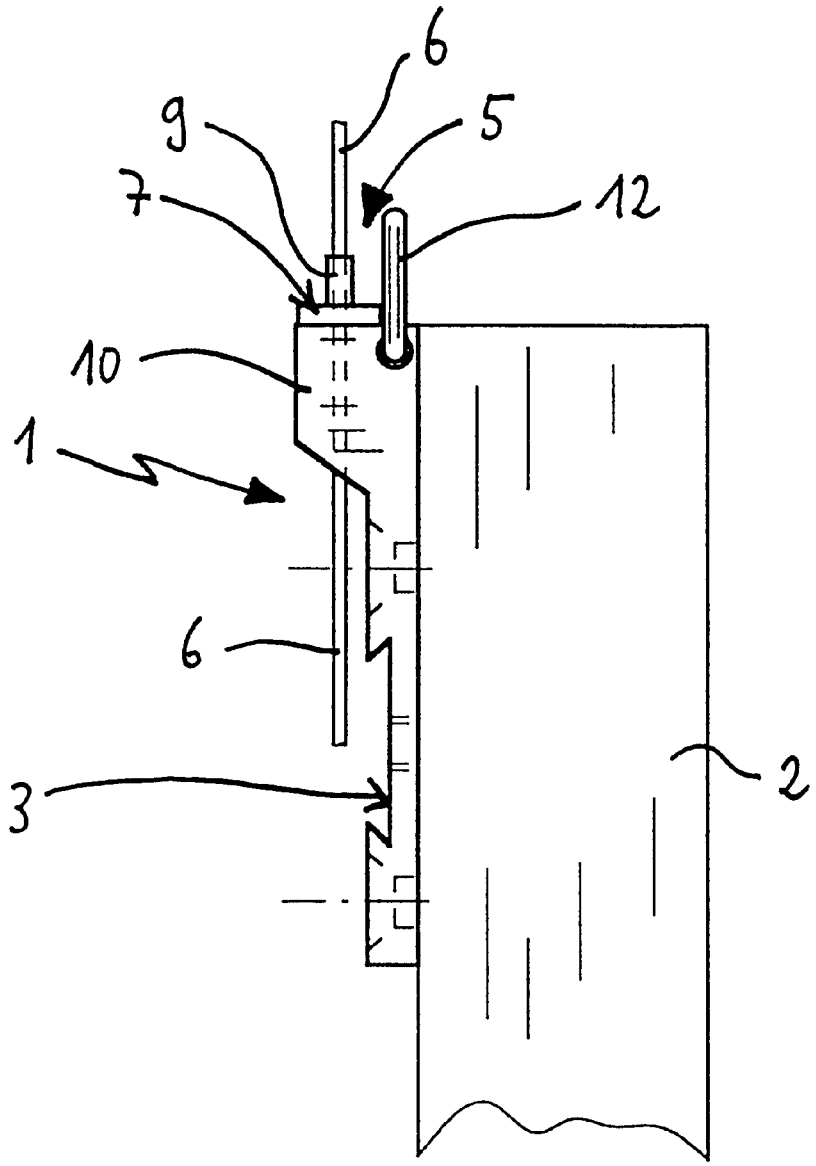
FIG. 2 is a side view of the corner area shown in FIG. 1.
Figure 3:
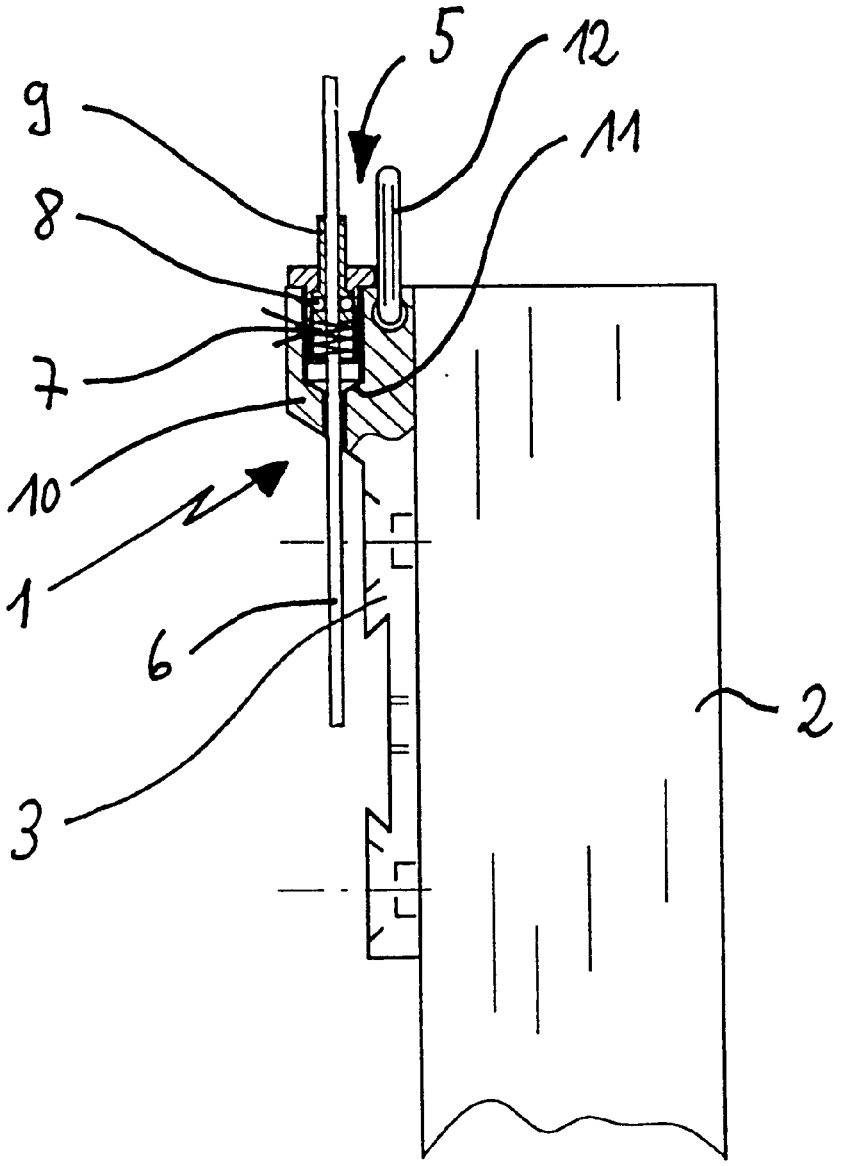
FIG. 3 is a schematic partial sectional side view of the corner area shown in FIG. 1.

FIGS. 1, 2, and 3 show a hanging system 1 in accordance with the invention together with an associated picture frame 2.

The hanging system 1 has several hangers 3 which are attached securely or permanently, especially in the corner areas of the picture frame 2 on the back—preferably by means of screws or the like. For protection of especially valuable paintings, the hangers 3 are preferably permanently attached to the picture frame 2 on the back side.

FIGS. 1, 2, and 3 show only one corner area with only one hanger 3. However, several hangers 3 if necessary can be located in the corner area. Preferably, these hangers 3 are provided in all of the corner areas of the picture frame 2; however, this is not absolutely necessary. For example, the hangers 2 which are explained in detail below can be located only in the upper corner areas.

FIG. 1 shows that the hanger 3 is made oblong or rail-like. Furthermore, the hanger 3 is made for detachably holding a support element 4 which is shown by the broken line. The support element 4 can be joined especially by interlocking to the hanger 3 such that a section of the support element 4 projects laterally beyond the picture frame 2 in order to enable holding, or preferably elastic support, of the picture frame 2 for transport purposes. With respect to other, especially structural details and embodiments and with respect to possible applications, reference is made additionally to the aforementioned EP 0 538 741 A1 and its indicated United States counterpart, U.S. Pat. No. 5,314,159.

To hang a picture frame 2, the support element 4 is either entirely detached from the hanger 3 or is pushed such that it no longer projects laterally beyond the picture frame 2. When the support element 4 is held adjustably by the hanger 3, especially with a capacity to be pushed or swiveled, but not detached, the advantage arises that the support element 4 cannot be lost, and therefore, it is captively connected to the hanging system 1 or its hanger 3.

The hanger 3 has a holding means 5 for the hanging cord 6. The hanger 3 can be detachably connected to the hanging cord 6 via the holding means 5. Accordingly, the hanging system 1, if necessary, allows the picture frame 2 to be hung on at least one hanging cord 6. In particular, conventional hanging on two hanging cords 6 in the area of the two upper corners of the picture frame 2 with the corresponding positioning of the hanger 3 is possible.

One important aspect of this invention is that the holding means 5 has a clamping means 7 which is or can be securely connected to the hanger 3. The expression "is" or "can be securely connected" is defined here in a broad sense such that if necessary the connection can be disconnected, especially for replacement or repair purposes. For example, it can be a screw connection, snap connection, catch connection, clamp connection or the like. However, the connection is made such that the clamping means 7 is connected at least captively to the assigned hanger 3 when the hanging system 1 is being used.

The clamping means 7 in this embodiment is made such that the hanging cord 6 can be inserted or pushed through in one direction, but can be fixed automatically by clamping in the other direction. This other direction corresponds to tensile loading with the picture frame 2 hung, so that the hanging picture frame 2 is protected against sliding through the hanging cord 6 and thus from falling down.

The clamping means 7, in the embodiment shown, has at least one spring-loaded clamping jaw 8 (FIG. 3) which can narrow the through channel for the hanging cord 6 in cross section and can interact with the hanging cord 6 such that the hanging cord 6 is held by clamping with a sufficient load-bearing capacity, and therefore, is protected against slipping through. Of course, the hanging cord is matched to the clamping means 7 with respect to its cross section and/or, for example, its material and its surface composition/roughness. Preferably, the hanging cord is a braided cord of steel or other suitably strong metal or the like.

The clamping means 7 is made preferably as a structural unit which, in the embodiment shown here, is screwed to/into, or otherwise integrated into, the hanger 3.

The clamping means 7 is preferably also provided with an actuation element 9 for releasing the clamp connection to the hanging cord 6, therefore for releasing the hanging cord 6 such that the hanging cord 6 can also be withdrawn from the clamping means 7 if necessary in what is otherwise the clamping direction. The actuation element 9 is sleeve-like here and projects out of the clamping means 7, and the hanging cord 6 can be inserted through the actuating element 9 into the clamping means 7. The actuating element 9 can be pressed against the force of the illustrated spring, by which the at least one clamping jaw 8 releases the hanging cord 6.

The hanger 3 has a contact section 10 which, in the embodiment shown, projects on the side of the hanger 3 facing away from the picture frame 2. In particular, the outside surface of the contact section 10 makes contact with the wall or the like when the picture frame 2 is hung. The contact section 10 leads at a defined distance of the back of the picture frame 2 to the wall which is not shown or the like and provides, for example, for back ventilation. In particular, the hanger 3, in the area of its contact section 10, has its greatest thickness.

The hanger 3 has a recess 11 for holding the clamping means 7. Preferably, the recess 11 is made in the contact section 10, and the clamping means 7, in the illustrated embodiment, can be essentially completely, or at least for the most part, inserted into the recess 11, especially screwed into it. The recess 11 therefore accommodates the clamping means 7 which forms a structural unit here.

Alternatively, the clamping means 7 can also be held, for example, by a catch or clamping by the recess 11.

A very compact structure of the hanger 3 results by the lengthwise axis of the hanger 3, which is made oblong or rail-like, running at least essentially parallel to the holding direction or insertion direction of the hanging cord 6. The lengthwise extension or main axis of the clamping means 7 therefore runs preferably at least essentially parallel to the indicated lengthwise axis of the hanger 3. However, here, other structural approaches are also possible.

The recess 11 is preferably made open on both sides so that the hanging cord 6 can be routed through the recess 11.

In addition, the holding means 5, in the embodiment shown, has a retaining clip 12 for versatile attachment, hanging or mounting of the picture frame 2. The retaining clip 12, in the embodiment shown, is at least essentially C-shaped, especially as described in EP 0 538 741 A1 or its above-mentioned U.S. counterpart.

The retaining clip 12 is also preferably made on the contact section 10 and is preferably supported to be able to pivot. The clamping means 7 and the retaining clip 12 yield a plurality of different attachment or hanging possibilities so that the hanging system 1 in accordance with the invention can be used in a very versatile manner especially with several hangers 3.

The hanger 3 is preferably made in one piece together with its contact section 10, especially from metal, preferably from an aluminum die casting. Thus, the desired load-bearing capacity is reached with comparatively low weight.

Of course, the hanger 3 can also have other forms instead of the oblong form shown here.

The subject matter of the invention is also a hanger 3 by itself, which can be used as an independently sold part of a hanging system 1 for a picture frame 2 or the like.

What is claimed is:

1. System for hanging picture frames and other essentially panel-shaped articles, the hanging system comprising at least one hanger which is fixedly attachable to a picture frame and on which a support element is detachably mountable and which is able to project beyond the picture frame or other essentially panel-shaped article to which the hanger is attached in use, the hanger having at least one holding means for a hanging cord by which the picture frame or other essentially panel-shaped article can be hung on the hanging cord;

wherein the holding means has a clamping means which is fixedly connected to the hanger and by which the hanging cord is fixedly securable to the hanger by clamping; and wherein at least one fastener is provided for fixedly attaching the hanger to the picture frame;

wherein the clamping means is adapted to enable the hanging cord to be moved therethrough in one direction, while automatically fixing the hanging cord by clamping in an opposite direction; and wherein the damning means has at least one spring-loaded clamping jaw for fixing the hanging cord.

2. Hanging system as claimed in claim 1, wherein the clamping means is integrated into the hanger.

3. Hanging system as claimed in claim 1, wherein the clamping means is provided with an actuation element for releasing the clamping of the hanging cord so as to enable the hanging cord to be withdrawn from the clamping means in said opposite direction.

4. Hanging system as claimed in claim 2, wherein the clamping means is provided with an actuation element for releasing the clamping of the hanging cord so as to enable the hanging cord to be withdrawn from the clamping means in said opposite direction.

5. Hanging system as claimed in claim 3, wherein the clamping means is integrated into the hanger.

6. Hanging system as claimed in claim 1, wherein the hanger has a recess within which the clamping means is mounted.

7. Hanging system as claimed in claim 6, wherein the recess is open on opposite sides for enabling the hanging cord to be routed through the recess.

8. Hanging system as claimed in claim 6, wherein the recess is located in a contact section of the hanger which projects on a side of the hanger opposite that which is attachable to the picture frame or other essentially panel-shaped article.

9. Hanging system as claimed in claim 6, wherein the clamping means is screwed into the recess of the hanger.

10. Hanging system as claimed in claim 6, wherein the clamping means is fixed in the recess of the hanger by one of catching and clamping.

11. Hanging system as claimed in claim 1, wherein the clamping means is screwed to the hanger.

12. Hanging system as claimed in claim 1, wherein the clamping means is detachably connected to the hanger.

13. System for banging picture frames and other essentially panel-shaped articles, the hanging system comprising at least one hanger which is fixedly attachable to a picture frame and on which a support element is detachably mountable and which the hanger is attached in use, the hanger having at least one holding means for a hanging cord by which the picture frame or other essentially panel-shaped article can be hung on the hanging cord;

wherein the holding means has a clamping means which is fixedly connected to the hanger and by which the hanging cord is fixedly securable to the hanger by clamping; and wherein at least one fastener is provided for fixedly attaching the hanger to the picture frame; wherein the holding means has a retaining clip for hooking onto a wall mounting element.

14. Hanging system as claimed in claim 13, wherein the retaining clip is pivotally supported on the hanger.

15. Hanging system as claimed in claim 13, wherein the hanger has a contact section which projects on a side of the banger opposite that which is attachable to a picture frame or other essentially panel-shaped article; wherein the retaining clip is pivotally supported on the contact section of the hanger; and wherein the clamping means is located in the contact section.

16. Hanger for picture frames and other essentially panel-shaped articles and which is attachable thereto, comprising a holding means for hanging a cord, the holding means having a clamping means fixedly connected to the hanger in which the hanging cord is fixedly securable by clamping; and wherein at least one fastener is provided for fixedly attaching the hanger to the picture frame;

wherein the clamping means is adapted to enable the hanging cord to be moved therethrough in one direction, while automatically fixing the hanging cord by clamping in an opposite direction; and wherein the clamping means has at least one spring-loaded clamping jaw for fixing the hanging cord.

17. Hanger as claimed in claim 16, wherein the clamping means is integrated into the hanger.

18. Hanger as claimed in claim 16, wherein the clamping means is provided with an actuation element for releasing the clamping of the hanging cord so as to enable the hanging cord to be withdrawn from the clamping means in said opposite direction.

19. Hanger as claimed claim 17, wherein the clamping means is provided with an actuation element for releasing the clamping of the hanging cord so as to enable the hanging cord to be withdrawn from the clamping means in said opposite direction.

20. Hanger as claimed in claim 18, wherein the clamping means is integrated into the hanger.

21. Hanger as claimed in claim 16, wherein the hanger has a recess within which the clamping means is mounted.

22. Hanger as claimed in claim 21, wherein the recess is open on opposite sides for enabling the hanging cord to be routed through the recess.

23. Hanger as claimed in claim 21, wherein the recess is located in a contact section of the hanger which projects on a side of the hanger opposite that which is attachable to the picture frame or other essentially panel-shaped article.

24. Hanger as claimed in claim 21, wherein the clamping means is screwed into the recess of the hanger.

25. Hanger as claimed in claim 21, wherein the clamping means is fixed in the recess of the hanger by one of catching and clamping.

26. Hanger as claimed in claim 16, wherein the clamping means is screwed to the hanger.

27. Hanger as claimed in claim 16, wherein the clamping means is detachably connected to the hanger.

28. Hanger for picture frames and other essentially panel-shaped articles and which is attachable thereto, comprising a holding means for hanging a cord, the holding means having a clamping means fixedly connected to the hanger in which the hanging cord is fixedly securable by clamping; and wherein at least one fastener is provided for fixedly attaching the hanger to the picture frame:

wherein the holding means has a retaining clip for hooking onto a wall mounting element.

29. Hanger as claimed in claim 28, wherein the retaining clip is pivotally supported on the hanger.

30. Hanger as claimed in claim 28, wherein the hanger has a contact section which projects on a side of the hanger opposite that which is attachable to a picture frame or other essentially panel-shaped article; wherein the retaining clip is pivotally supported on the contact section of the hanger; and wherein the clamping means is located in the contact section.

* * * * *